US012158327B2

(12) United States Patent
McNicholas et al.

(10) Patent No.: US 12,158,327 B2
(45) **Date of Patent: *Dec. 3, 2024**

(54) FRAGMENTATION PATTERN, OPTIMIZED FOR DRAWN CUP WARHEADS WITH A DOME AND CYLINDRICAL WALL

(71) Applicant: The United States of America, as represented by the Secretary of the Navy, Crane, IN (US)

(72) Inventors: William E. McNicholas, Ellettsville, IN (US); Joshua E. Gwaltney, Sandborn, IN (US); Eric Scheid, Bloomington, IN (US); Matt E. Cummings, Bedford, IN (US); Andrew Richard Davis, Mesa, AZ (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/213,476

(22) Filed: Jun. 23, 2023

(65) Prior Publication Data

US 2024/0044623 A1 Feb. 8, 2024

Related U.S. Application Data

(63) Continuation of application No. 17/876,231, filed on Jul. 28, 2022, now Pat. No. 11,725,916.

(51) Int. Cl.

| | |
|---|---|
| ***F42B 12/24*** | (2006.01) |
| ***F42B 12/22*** | (2006.01) |
| ***F42B 27/00*** | (2006.01) |

(52) U.S. Cl.

CPC ..... *F42B 12/24* (2013.01); *F42B 12/22* (2013.01); *F42B 27/00* (2013.01)

(58) Field of Classification Search

CPC ..... F42B 12/22; F42B 12/24; F42B 27/00

(Continued)

(56) References Cited

U.S. PATENT DOCUMENTS 3,566,794 A * 3/1971 Pearson ..... F42B 12/22 102/493

3,590,451 A * 7/1971 Dessart ..... F42B 12/24 86/51

(Continued)

FOREIGN PATENT DOCUMENTS

IT 1055389 B * 12/1981 ..... F42B 1/036

OTHER PUBLICATIONS

Machine translation of IT-1055389-B (Year: 1981).*

*Primary Examiner* — James S Bergin

(74) *Attorney, Agent, or Firm* — Naval Surface Warfare Center, Crane Division; Christopher Feigenbutz

(57) ABSTRACT

Provided is a frangible munitions device optimized for a dome and cylinder that yields fragments having shapes corresponding to a predetermined embossment pattern upon explosive rupture. The embossment pattern includes a first set of inner regular hexagonal embossments formed into the dome and cylinder that are aligned with the axis of the cylinder, and a second set of outer pre-deformed hexagonal shapes that distort to produce regular hexagonal shapes after drawing into the cylinder wall. The second set of shapes are separated by sharp transition regions. The shapes are embossed in a repeated pattern around the hollow cylinder and the dome top. The dome yields a plurality of fragments having shapes corresponding to the first set of inner regular hexagonal embossments upon explosive rupture, while the cylinder yields a plurality of fragments having shapes corresponding to the second set of outer pre-deformed hexagonal embossments upon explosive rupture.

8 Claims, 9 Drawing Sheets

(58) Field of Classification Search
USPC ..... 102/482, 491, 493, 494, 495
See application file for complete search history.

(56) References Cited

U.S. PATENT DOCUMENTS

| | | | | | |
|---|---|---|---|---|---|
| 4,068,590 | A * | 1/1978 | Pearson | F42B 12/24 | 102/493 |
| 4,774,745 | A * | 10/1988 | Carter | F42B 12/24 | 86/53 |
| 4,977,657 | A * | 12/1990 | Engel | F42B 12/24 | 102/493 |
| 5,040,464 | A * | 8/1991 | Pearson | F42B 12/24 | 102/493 |
| 8,973,503 | B2 * | 3/2015 | Dunaway | B22F 7/02 | 102/374 |
| 9,738,947 | B1 * | 8/2017 | Deshpande | C21D 1/06 | |
| 9,738,948 | B2 * | 8/2017 | Gwaltney | C21D 1/06 | |
| 11,578,958 | B2 * | 2/2023 | Rastegar | F42B 10/38 | |
| 11,725,916 | B2 * | 8/2023 | McNicholas | F42B 12/24 | 102/495 |
| 2023/0132848 | A1 * | 5/2023 | Griffiths | F42B 12/32 | 102/495 |

* cited by examiner

FRAGMENTATION PATTERN, OPTIMIZED FOR DRAWN CUP WARHEADS WITH A DOME AND CYLINDRICAL WALL

CROSS-REFERENCE TO RELATED APPLICATIONS

The present application is a continuation of patent application Ser. No. 17/876,231, filed Jul. 28, 2022, entitled "FRAGMENTATION PATTERN, OPTIMIZED FOR DRAWN CUP WARHEADS WITH A DOME AND CYLINDRICAL WALL," which claims priority to U.S. Provisional Patent Application Ser. No. 63/228,278, filed Aug. 2, 2021, entitled "FRAGMENTATION PATTERN, OPTIMIZED FOR DRAWN CUP WARHEADS WITH A DOME AND CYLINDRICAL WALL," the disclosures of which are expressly incorporated by reference herein.

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon. This invention (Navy Case 200570US03) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD OF THE INVENTION

The field of invention relates generally to frangible munitions. More particularly, it pertains to a frangible munitions device optimized for a dome and cylinder that yields a plurality of fragments having shapes corresponding to a predetermined embossment pattern upon explosive rupture.

BACKGROUND

Fragmentation munitions have existed for centuries. The current generation of hand grenade style fragmentation munitions typically either include solid warhead cases or projectiles embedded in a composite case. The former has a mass producibility advantage but a disadvantage in prototyping and development associated with tooling costs. Solid warhead case munitions also suffer from disadvantages associated with typical methods of case assembly (i.e. welding), which limits other aspects of production (i.e. explosive filling options) and creates a region of material disrupted by the act of welding.

Embedded projectiles are easier to experiment with and offer the advantage of enhanced creativity. Embedded projectiles are more likely to disperse in a regular pattern and with a consistent mass and size. However, these solutions are typically difficult to produce and suffer from inefficient energy transfer from the explosive to the fragments. As can be appreciated, the act of breaking the case reduces the overall percentage of energy transfer.

Solid cased warheads, while more efficient in energy transfer, often break irregularly in spite of intentional scoring. This irregularly results in less than optimal spread of fragments and distribution of fragment mass and size. Intentional scoring typically consists of either stamped (embossed) or machined shapes. The shapes are chosen by the shape of the warhead. Warheads that are essentially round (grenades) favor hexagonal shapes as hexagons are easy bent in a sphere. Cylindrical warhead fragmentation has been optimized by the US Navy "Pearson Notch", as shown in U.S. Pat. No. 5,040,464 A).

An alternative is the Advanced Frag Grenade (AFG) that could not practically incorporate the Pearson Notch and was not suited for traditional hexes. The original AFGs were built with stamped hexagons, but the pattern deformed in the cylindrical wall section, thereby causing less than optimal fracture of the steel. Machining Pearson Notches into the cylindrical wall of the AFG was not practical and would have involved considerable cost and still required stamp and drawing. Pearson Notches are not practical to draw and the physics associated with them are not applicable to hexagons or spherical surfaces, as they are unique to cylinders. As can be appreciated from the above, a new pattern is needed for use with munitions that utilize a dome and cylinder in order to yield a more even distribution of fragments upon explosive rupture.

SUMMARY OF THE INVENTION

The present invention relates to frangible munition devices optimized for a dome and cylinder that yields fragments having shapes corresponding to a predetermined embossment pattern upon explosive rupture. The embossment pattern includes a first set of inner regular hexagonal embossments formed into the dome and cylinder that are aligned with the axis of the cylinder, and a second set of outer pre-deformed hexagonal shapes that distort to produce regular hexagonal shapes after drawing into the cylinder wall. The second set of outer pre-deformed hexagonal shapes are separated by sharp transition regions. The first and second shapes are embossed in a repeated pattern around the hollow cylinder and the dome top. The dome yields a plurality of fragments having shapes corresponding to the first set of inner regular hexagonal embossments upon explosive rupture, while the cylinder yields a plurality of fragments having shapes corresponding to the second set of outer pre-deformed hexagonal embossments upon explosive rupture.

The new combined pattern allows munitions to disperse in a regular pattern with a consistent mass and size and provides an efficient energy transfer.

According to an illustrative embodiment of the present disclosure, it is an object of the invention to provide a new and improved frangible munitions device optimized for a dome and cylinder that has all the advantages of the prior art and none of the disadvantages.

According to a further illustrative embodiment of the present disclosure, it is an object of the invention to provide a new and improved frangible munitions device that utilizes an embossed design that is optimal for both domed and cylindrical section of the same munition.

According to a yet another illustrative embodiment of the present disclosure, it is an object of the invention to provide a new and improved frangible munitions device that is achievable with practical manufacturing means.

According to a further illustrative embodiment of the present disclosure, it is an object of the invention to provide a new and improved frangible munitions device that provides a more even distribution of fragments and more regularly shaped fragmentation.

According to a yet another illustrative embodiment of the present disclosure, it is an object of the invention to provide a new and improved frangible munitions device that improves the probability of hitting a target within the effective radius.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Generally, provided is a frangible munitions device optimized for a dome and cylinder which yields a plurality of fragments having shapes corresponding to a predetermined embossment pattern upon explosive rupture, comprising a dome top having an inner surface and a hollow cylinder having an inner surface and an axis. In an illustrative embodiment, the inner surface defines a first set of inner regular hexagonal embossments formed into the dome and cylinder and aligned with the axis of the cylinder. In an illustrative embodiment, the inner surface defines a second set of outer pre-deformed hexagonal shapes that distort to produce regular hexagonal shapes after drawing into the cylinder wall. In an illustrative embodiment, the second set of outer pre-deformed hexagonal shapes are separated by sharp transition regions. In an illustrative embodiment, the first and second shapes are embossed in a repeated pattern around the hollow cylinder and the dome top. In an illustrative embodiment, the dome yields a plurality of fragments having shapes corresponding to the first set of inner regular hexagonal embossments upon explosive rupture. In an illustrative embodiment, the cylinder yields a plurality of fragments having shapes corresponding to the second set of outer pre-deformed hexagonal embossments upon explosive rupture.

In an illustrative embodiment, the sharp transition regions comprise narrow and abrupt transition regions. In an illustrative embodiment, the narrow and abrupt transition regions comprise 90 degree embossments drawn into the cylinder and dome to a depth of 0.10 inches. In an illustrative embodiment, the 90-degree embossments have a spacing of 0.112 inches off center. In an illustrative embodiment, the cylinder is steel. In an illustrative embodiment, the embossments are formed in the inner wall by stamping and drawing.

Figure 1:
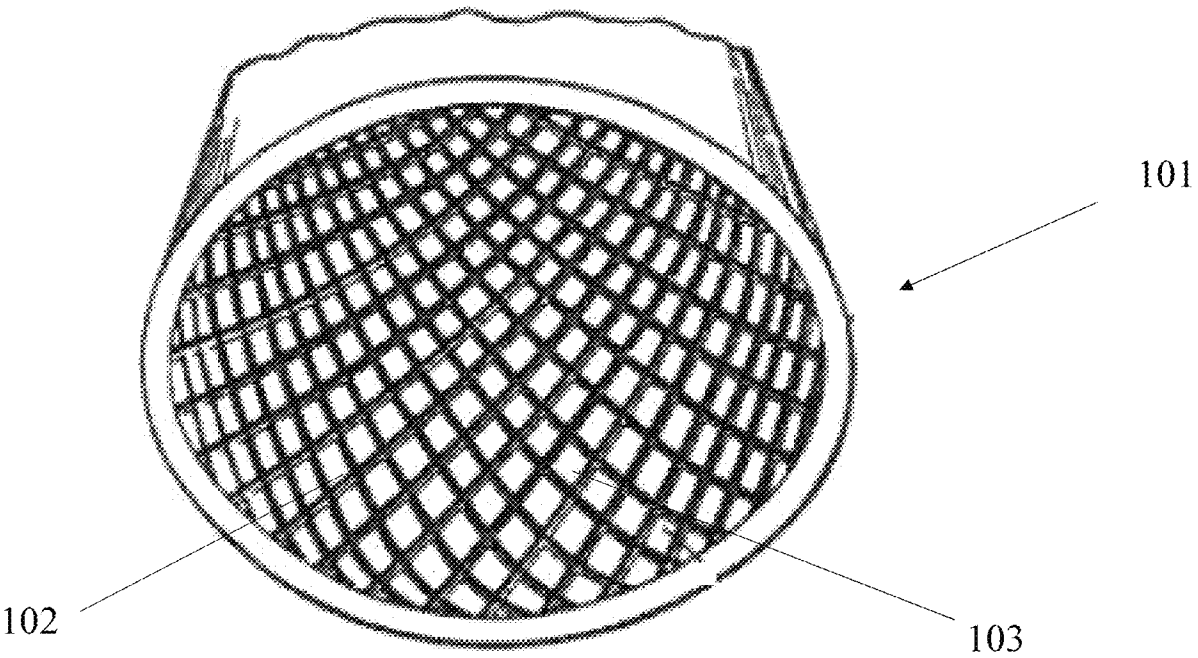
FIG. 1 (prior art)
FIG. 1 shows a prior art embossment pattern optimized for cylindrical munitions.

FIG. 1 shows a prior art embossment pattern 101 optimized for cylindrical munitions. Solid cased warheads, while more efficient in energy transfer, often break irregularly, in spite of intentional scoring. This irregularly results in less than optimal spread of fragments and distribution of fragment mass and size. Intentional scoring 102 typically consists of either stamped (embossed) or machined shapes. These shapes are chosen by the shape of the warhead. Warheads that are essentially round (grenades) favor hexagonal shapes as hexagons are easy bent in a sphere. Warheads that are cylindrical favor the "Pearson Notch" 103 as described in U.S. Pat. No. 5,040,464 A, which is incorporated by reference in its entirety. The scoring method is well established to take advantage of shock/fracture mechanics to form regular fragments from machined cylinders or other methods able to replicate the Pearson Notch geometry.

Figure 2:
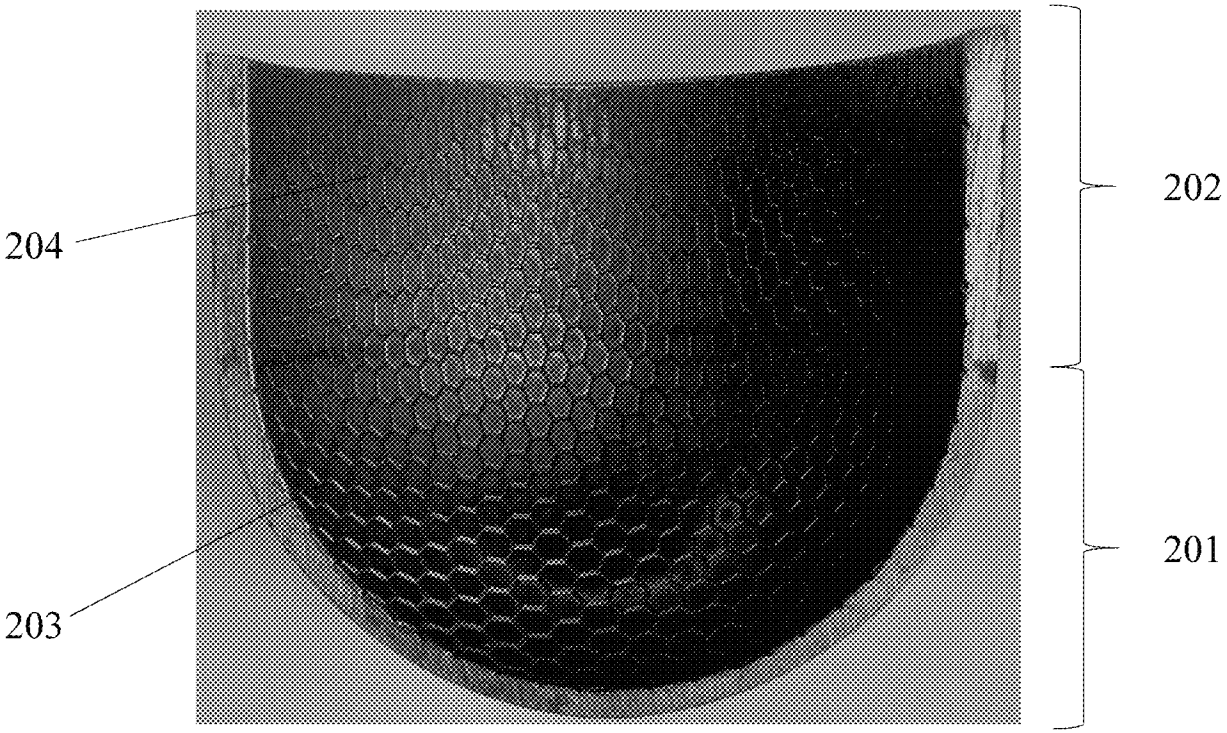
FIG. 2 (prior art)
FIG. 2 shows a prior art cutaway domed section that distorts around a cylinder.

FIG. 2 shows a prior art cutaway domed section 201 that distorts around a cylinder 202. The prior art cutaway domed section 201 comprises a warhead (NSWC Crane Advanced Frag Grenade or "AFG") that could not practically incorporate the Pearson Notch nor was it suited for traditional hexagons. The original AFGs were built with stamped hexagons 203 but the pattern deformed 204 in the cylindrical wall section 202 causing less than optimal fracture of the steel. Machining Pearson Notches in the cylindrical wall of the AFG was not practical and would have involved considerable cost and still required stamp and drawing. As can be appreciated, Pearson Notches are not practical to draw and the physics associated therewith are not applicable to hexagons or spherical surfaces, as they are unique to cylinders.

An ideal fragment pattern for the AFG was envisioned that would be either a series of regular hexagons extending up the cylindrical section or hexagons on the dome and Pearson Notches cut into the cylinder. Making this pattern, however, would require either very difficult machining or additive manufacturing. As can be appreciated, additive manufacturing has proven to make effective fragments but has not proven practical or cost effective for grenade-scale munitions. The most practical, efficient, and effective means of producing this class of warhead remains stamping and drawing.

Figure 3:
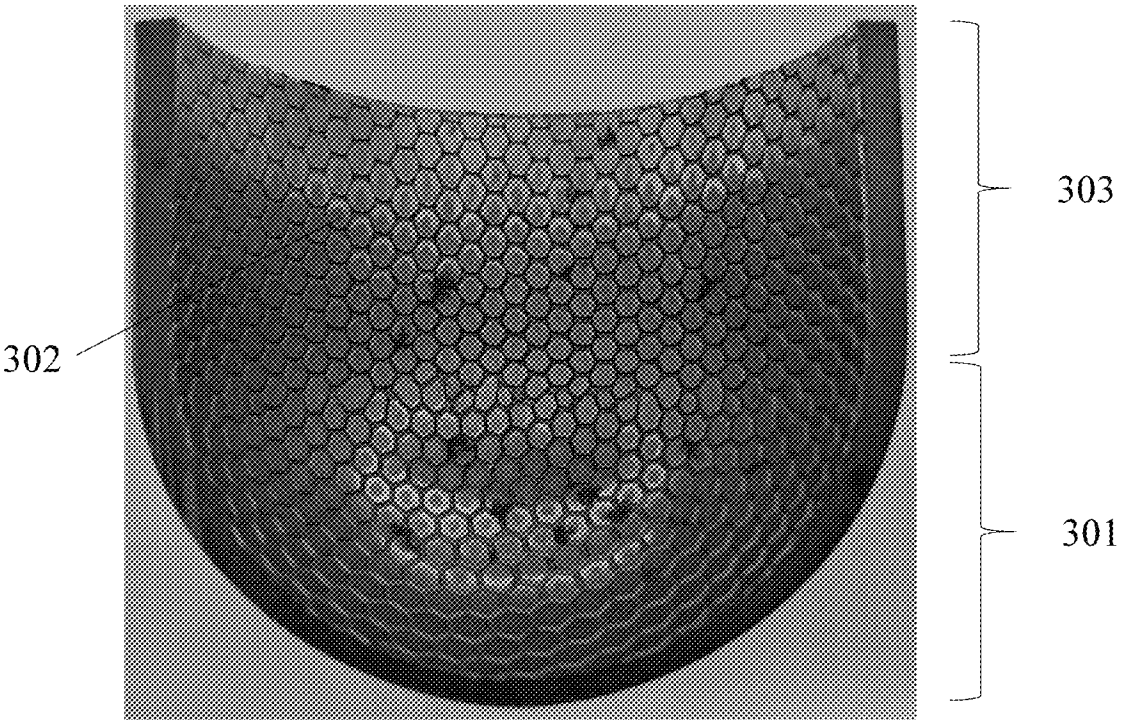
FIG. 3 shows a cutaway domed section utilizing pre-deformed hexagonal shapes that distort to produce regular hexagonal shapes around a cylinder.

FIG. 3 shows a cutaway domed section 301 utilizing pre-deformed hexagonal shapes that distort to produce regular hexagonal shapes 302 around a cylinder 303. An alternative method of making a pattern comprising a series of regular hexagons extending up the cylindrical section and into the dome was accomplished. This desired pattern required the prediction of the shape of a plurality of pre-deformed hexagons that would then result in an ideal hexagon 302 shape post-drawing. In an illustrative embodiment, the recognition that the pattern suited for the cylindrical section 303 needed to be oriented with respect to the cylinder aided in achieving the desired embossed pattern. In this configuration, the consistent pattern would remain regular within the domed section 301 but distort around the cylinder 303 to create the desired regular hexagons.

Figure 4:
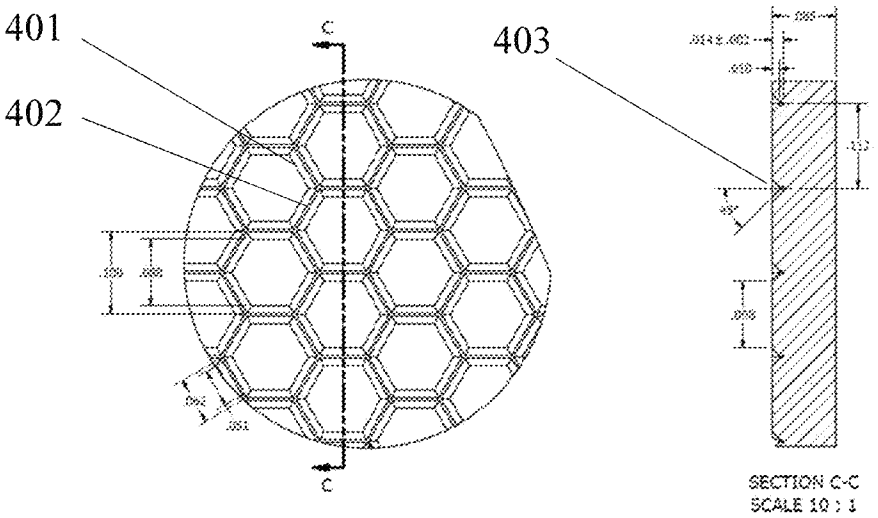
FIG. 4 shows a close-up view of the first set of inner regular hexagonal embossments and the second set of outer pre-deformed hexagonal shapes that distort to produce regular hexagonal shapes after drawing into said cylinder wall.
Figure 5:
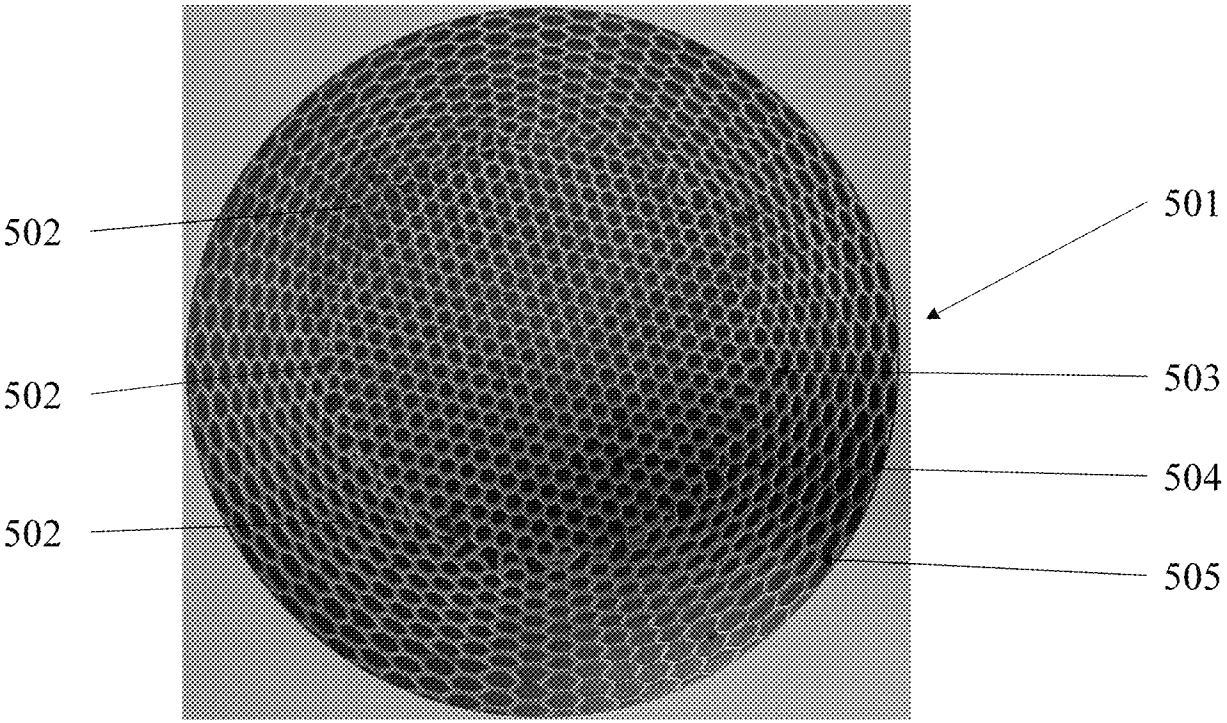
FIG. 5 shows the combined stamp pattern of inner regular hexagonal embossments and outer pre-deformed hexagonal shapes that distort to produce regular hexagonal shapes.

FIG. 4 shows a close-up view of the first set of inner regular hexagonal embossments 401 and the second set of outer pre-deformed hexagonal shapes 402 that distort to produce regular hexagonal shapes after drawing into the cylinder wall. In an illustrative embodiment, the inner regular hexagonal embossments 401 comprise a series of traditional, regular hexagonal embossments. The inner regular hexagonal embossments 401 are surrounded by a region of pre-deformed or distorted hexagons 402 separated by "sharp" (narrow and abrupt) transition regions 403. For illustration purposes, the close-up view of the distorted hexagons 402 shown in FIG. 4 are from the dome section, where distortion is less necessary and visible. Illustrative distorted hexagons are evident in FIG. 5, which shows the combined stamp pattern 501 of inner regular hexagonal embossments and outer pre-deformed hexagonal shapes 502 that distort to produce regular hexagonal shapes. Distorted hexagonal shapes 502 are evident around the transition region 503 between the dome 504 and cylinder 505.

Figure 6:
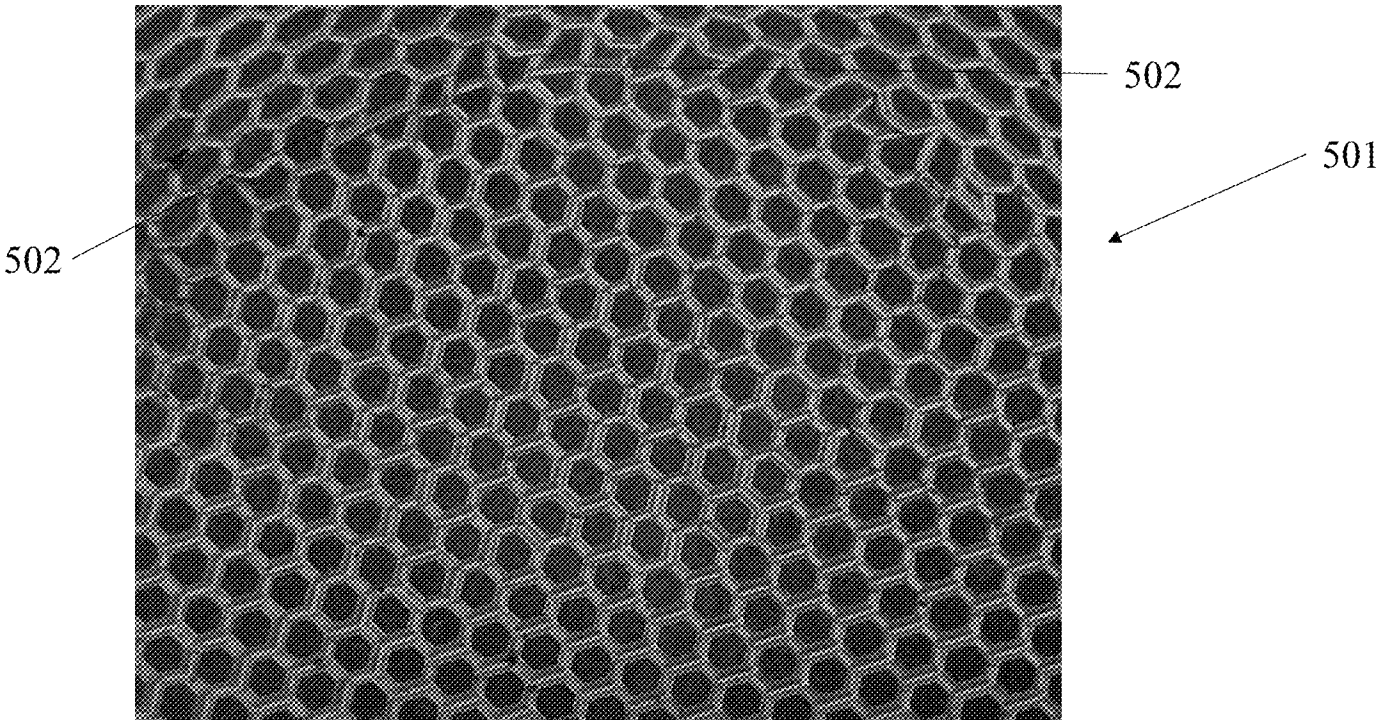
FIG. 6 shows a close-up view of the combined stamp pattern of inner regular hexagonal embossments and outer pre-deformed hexagonal shapes that distort to produce regular hexagonal shapes.

FIG. 6 shows a close-up view of the combined stamp pattern 501 of inner regular hexagonal embossments and outer pre-deformed hexagonal shapes that distort to produce regular hexagonal shapes. The distorted hexagonal shapes 502 are particularly evident here. As can be appreciated, when the inner wall of the munition is embossed with the stamp pattern 501, it produces produce regular hexagonal shapes 302 around the dome 301 and cylinder 303, as shown in FIG. 3. In other words, the pattern illustrated in 501, when stamped inside a cylinder and dome, produces the pattern shown in 301.

Testing

Figure 7B:
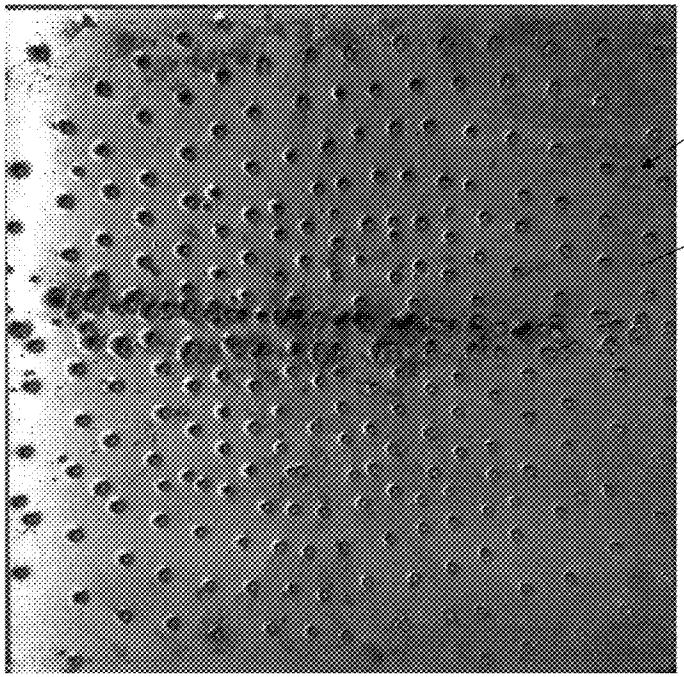
FIG. 7B shows the pattern results of a sample fragmentation witness plate resulting from a munition utilizing a combined stamp pattern of inner regular hexagonal embossments and outer pre-deformed hexagonal shapes that distort to produce regular hexagonal shapes.
Figure 7A:
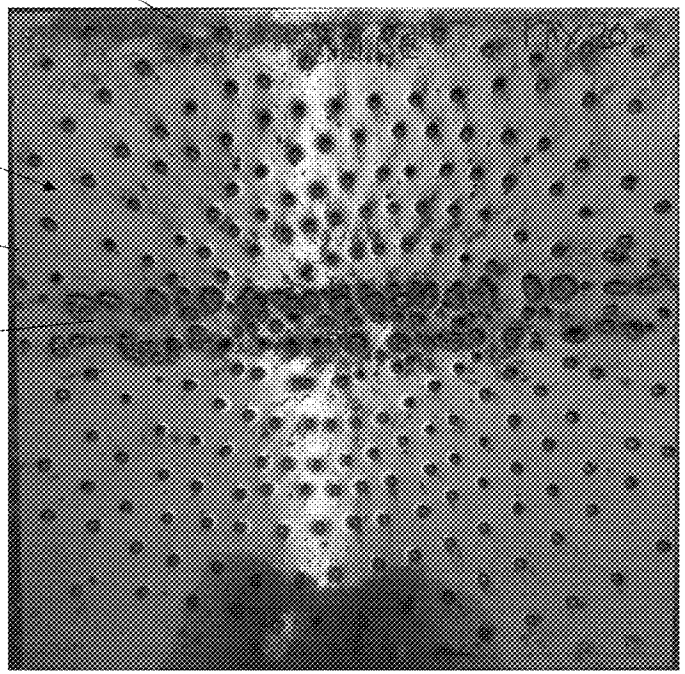
FIG. 7A shows the pattern results of a sample fragmentation witness plate resulting from a munition utilizing a prior art embossment pattern.

FIG. 7A shows the pattern results 701 of a sample fragmentation witness plate 702 resulting from a munition utilizing a prior art embossment pattern, and FIG. 7B shows the pattern results 703 of a sample fragmentation witness plate 704 resulting from a munition utilizing a combined stamp pattern of inner regular hexagonal embossments and outer pre-deformed hexagonal shapes that distort to produce regular hexagonal shapes. Particularly evident are the first and second areas of highly concentrated blast fragments 705, 706. In contrast, the inventive device produces a pattern 703 with improve the formation and dispersion of fragments that are significantly improved as compared to the prior art embossment pattern.

Figure 8B:
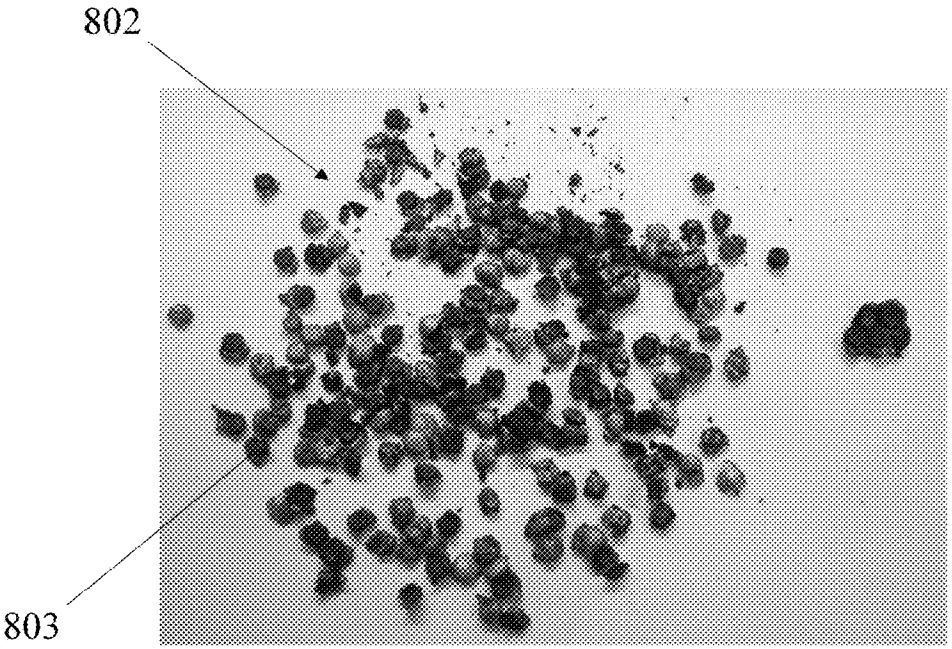
FIG. 8B shows the sample fragments retrieved from a munition utilizing a combined stamp pattern of inner regular hexagonal embossments and outer pre-deformed hexagonal shapes that distort to produce regular hexagonal shapes.
Figure 8A:
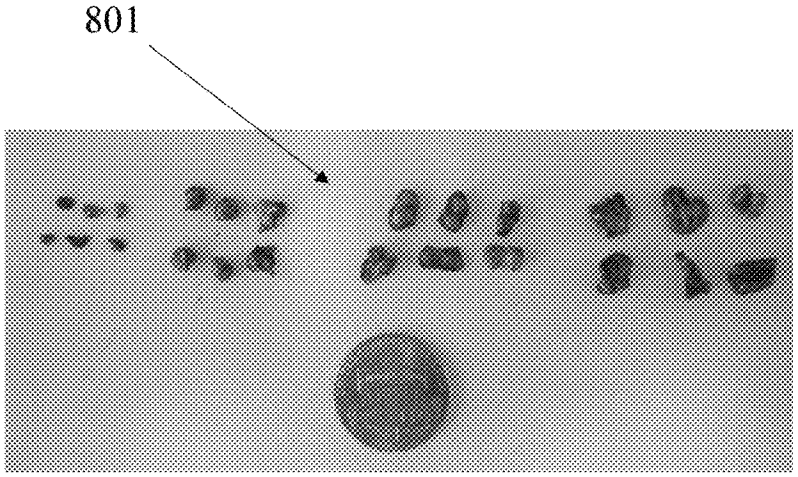
FIG. 8A shows the sample fragments retrieved from a munition utilizing a prior art embossment pattern.

Tangible improvements associated with the inventive design are shown relative to the poor fragmentation, as evident in FIG. 8A, which shows the sample fragments 801 retrieved from a munition utilizing a prior art embossment pattern, as compared to FIG. 8B, which shows the sample fragments 802 retrieved from a munition utilizing a combined stamp pattern of inner regular hexagonal embossments and outer pre-deformed hexagonal shapes that distort to produce regular hexagonal shapes. When the inventive pattern is impacted with shock or similar energy transfer, the result is a fracture of the material coincident with the pattern. In other words, the fragments 802 have a consistent size and shape 803 similar to that of the embossments, compared to the irregular size and shape 801 from the prior art embossment pattern. Experimentation with Person Notches and hexagons in domes and cylinders, and an analysis of the fragments 802 illustrate that the dome yields fragments having shapes corresponding to the first set of inner regular hexagonal embossments and the cylinder yields fragments having shapes corresponding to the second set of outer pre-deformed hexagonal embossments upon explosive rupture.

Figure 9:
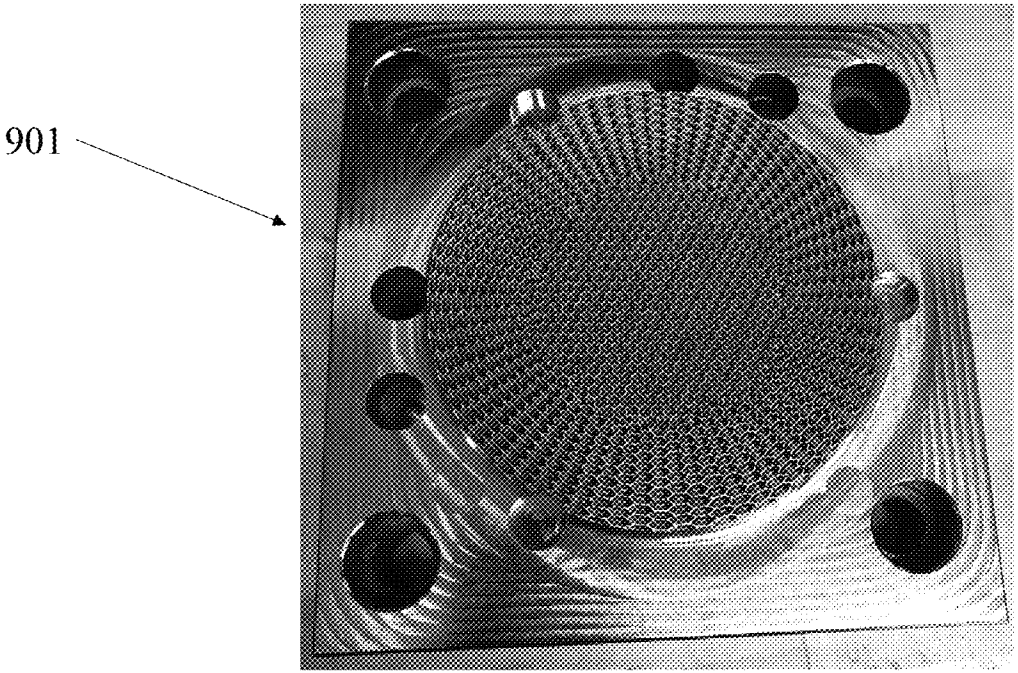
FIG. 9 shows the stamping tool utilizing a combined stamp pattern of inner regular hexagonal embossments and outer pre-deformed hexagonal shapes that distort to produce regular hexagonal shapes.

The inventive design utilizing a first set of inner regular hexagonal embossments and a second set of outer pre-deformed hexagonal embossments that distort to produce regular hexagonal shapes after drawing into a cylinder wall provides a design optimal for both domed and cylindrical section of the same warhead. The inventive design is achievable with practical manufacturing means, such as with stamp and draw instead of machining or additive manufacturing. FIG. 9 shows the stamping tool 901 utilizing a combined stamp pattern of inner regular hexagonal embossments and outer pre-deformed hexagonal shapes that distort to produce regular hexagonal shapes. The stamp tool 901 provides a pattern that yields a more even distribution of fragments, thereby improving the probability of hitting a target within the effective blast radius. The inventive design provides more regular fragmentation and improved consistency of fragment performance.

In an illustrative embodiment, the inventive design can be utilized in a hand grenade constructed of steel. In an illustrative embodiment, the inventive design can be scaled for a given weapon size. In an illustrative embodiment, the inventive design can be adapted to other systems and materials where matching the contour of a cylinder and dome are required of a structure formed at the same time.

Although the invention has been described in detail with reference to certain preferred embodiments, variations and modifications exist within the spirit and scope of the invention as described and defined in the following claims.

The invention claimed is:

1. A frangible munition, comprising:

an inner surface defining a first set of inner regular hexagonal embossments;

a second set of outer pre-deformed hexagonal shapes that distort to produce regular hexagonal shapes after drawing into said inner surface; and an outer surface positioned outside said inner surface.

2. The device of claim 1, wherein said second set of outer pre-deformed hexagonal shapes are separated by sharp transition regions.

3. The device of claim 1, wherein said frangible munition comprises a dome top having an inner surface and a hollow cylinder having an inner surface and an axis;

wherein said inner surface of said dome tope and said inner surface of said hollow cylinder are continuous with one another and form an inner surface of said frangible munition.

4. The device of claim 3, wherein said first set of inner regular hexagonal embossments and second set of outer pre-deformed hexagonal shapes are embossed in a repeated pattern around said hollow cylinder and said dome top.

5. The device of claim 3, wherein said dome yields a plurality of fragments having shapes corresponding to said first set of inner regular hexagonal embossments upon explosive rupture; and wherein said cylinder yields a plurality of fragments having shapes corresponding to said second set of outer pre-deformed hexagonal embossments upon explosive rupture.

6. A frangible munition, comprising:

a dome top having an inner surface; and a hollow cylinder having an inner surface and an axis; and an outer surface positioned outside said inner surface;

wherein said inner surface of said dome tope and said inner surface of said hollow cylinder are continuous with one another and form an inner surface of said frangible munition;

said inner surface defining a first set of inner regular hexagonal embossments formed into said dome and cylinder and aligned with said axis of said cylinder; and said inner surface defining a second set of outer pre-deformed hexagonal shapes that distort to produce regular hexagonal shapes after drawing into the cylinder wall;

wherein said dome yields a plurality of fragments having shapes corresponding to said first set of inner regular hexagonal embossments upon explosive rupture; and wherein said cylinder yields a plurality of fragments having shapes corresponding to said second set of outer pre-deformed hexagonal embossments upon explosive rupture.

7. The device of claim 6, wherein said first set of inner regular hexagonal embossments and second set of outer pre-deformed hexagonal shapes are embossed in a repeated pattern around said inner surface.

8. The device of claim 6, wherein said second set of outer pre-deformed hexagonal shapes are separated by sharp transition regions.

* * * * *